United States Patent [19]

Miyabe

[11] 4,041,479

[45] Aug. 9, 1977

[54] OUTPUT CIRCUIT OF AN IONIZATION SMOKE SENSOR

[75] Inventor: Atsushi Miyabe, Tokyo, Japan

[73] Assignee: Hochiki Corporation, Japan

[21] Appl. No.: 656,701

[22] Filed: Feb. 9, 1976

[30] Foreign Application Priority Data

Feb. 10, 1975 Japan ..... 50-17774[U]

[51] Int. Cl.[2] ..... G08B 21/00

[52] U.S. Cl. ..... 340/237 S; 250/381

[58] Field of Search ..... 340/237 S, 213.1, 253 C; 250/381, 385; 307/255, 252 J

[56] References Cited

U.S. PATENT DOCUMENTS

| | | | |
|---|---|---|---|
| 3,717,862 | 2/1973 | Sasaki | 340/237 S |
| 3,728,703 | 4/1973 | Burnett | 340/237 S |
| 3,906,474 | 9/1975 | Lehsten | 340/237 S |

FOREIGN PATENT DOCUMENTS

| | | | |
|---|---|---|---|
| 1,378,652 | 12/1974 | United Kingdom | 307/252 J |

*Primary Examiner*—John W. Caldwell
*Assistant Examiner*—Daniel Myer
*Attorney, Agent, or Firm*—Robert E. Burns; Emmanuel J. Lobato; Bruce L. Adams

[57] ABSTRACT

An ionization smoke sensor including a pair of ionization chambers normally biased to maintain an ionic current which varies in response to smoke particles within one of the chambers. A normally non-conductive transistor is biased to conduct when an impedance change of the combination of ionization chambers, caused by the smoke, exceeds a certain amount. The conductive transistor in turn biases a thyristor to conduct to actuate an alarm circuit. A comparator circuit is connected between the transistor and the thyristor for providing a biased signal therebetween. The biased signal is not applied by the comparator until the current through the conductive transistor exceeds a certain threshold value. Consequently, leakage currents of the transistor when it is non-conductive are isolated from the thyristor to prevent erroneous triggering of the same.

4 Claims, 3 Drawing Figures

OUTPUT CIRCUIT OF AN IONIZATION SMOKE SENSOR

BACKGROUND OF THE INVENTION

1. Field of the Invention

This invention relates to an alarm circuit which detects combustion products such as smoke, vapor and the like by the use of an ionization smoke sensor having a high impedance. More particularly, it relates to a large number of high impedance alarm circuits connected to a common d.c. power source independently of one another, in which power to be dissipated on the basis of impedance changes smaller than an impedance change at a predetermined alarm generating level of the sensor is reduced and in which a required operating voltage is stably supplied.

2. Description of the Prior Art

U.S. Pat. No. 3,733,596 discloses an alarm system in which a normalized normal voltage is applied to ionization smoke sensors having a high impedance and in which a free running multivibrator (FMV) is employed in order that a certain impedance change may be normally bestowed on a field effect transistor (FET) by a measurement output of the sensor (refer to FIG. 1). The FMV is a pulse switching unit, which produces a continuous signal train of intermittent pulses. The duration of the output pulses provided at relatively long quiescent intervals is made shorter. Within the period of time during which the output pulse is impressed, the impedance change of the ionization smoke sensor ascribable to combustion products such as smoke having entered thereinto is transmitted to the FET. Although the use of the intermittent pulse train can reduce the power dissipation, it is empirically known that a combustion product detecting circuit which exploits an ionic current maintaining a high impedance can have the reliability of the detection lost. The FMV adopted in the prior art employs FET's at the input and output ends thereof, and the intermittent pulses to be produced thereby cannot satisfactorily be stabilized under the present technological situation. Due to the synergy between such comparatively unstable pulse train and the influence of a fluctuation of the intensity of the applied voltage on the ionic current, the loss of the detection accuracy (for example, a case where the detecting operation was not effected in spite of the presence of the combustion product, or a case where it was effected in spite of the absence of the combustion product at the alarm level) may possibly have been experienced.

The FET having received the impedance change of the ionization smoke sensor delivers an amplified current corresponding thereto to a transistor, and the signal further amplified by the transistor triggers a thyristor. The thyristor short-circuits a power source, and a relay incorporated in a short-circuiting loop is energized for the first time by a current increased by the short-circuit. The relay actuates an alarm sounding or displaying circuit which is separately constructed.

FIG. 2 shows a comparator circuit wherein the foregoing FMV is removed which is not always apprehended to be favorably combined with the high impedance circuit involving the ionic current changing under the external influences. In this example for reference, to the end of reducing the power dissipation, a zener diode and a resistance are connected in series to the drain of the FET subject to the impedance change of the ionization smoke sensor, and the operating condition of the zener diode is determined in correspondence with the alarm issuing level. A transistor adapted to be rendered conductive by a voltage which appears across the resistance when a zener current develops is connected to the juncture between the zener diode and the resistance. A thyristor which is triggered by the "on" operation of this transistor constitutes the shortcircuiting loop described above. However, the reduction of the power dissipation owing to the zener diode is subject to an apparent limit, and the number by which the high impedance circuits can be connected to the common d.c. power source independently of one another is restricted. The thyristor of the shorting circuit is not rendered conductive by impedance changes which do not come up to the alarm issuing level. Since, however, the slight zener currents corresponding to the impedance changes below the predetermined level exist, the current leakage of the transistor Q is of an unnegligible amount. The leakage current of the transistor increases suddenly as the impedance change approaches to the alarm issuing level. Even in the absence of any cause for a fire, the impedance of the ionization smoke sensor continues to sensitively vary due to other factors. Actually, therefore, the impedance changes close to the alarm generating level determined for avoiding false alarms arise more frequently than anticipated.

As the number of the high impedance circuits having the ionization smoke sensors connected to the common d.c. power source is larger, the increase of the leakage current occurring in the transistor as corresponds to the impedance change exerts a greater influence on the operating conditions necessary for the circuits, so that the voltage to be applied across an inner electrode 1 and an outer electrode 5 of the ionization smoke sensor lowers to the extent of losing the normal detecting function. When, as in a fire of smoldering fibrous materials in which the amount of smoke increases very slowly, a plurality of ionization smoke sensors are exposed to the gradually increasing smoke for a long period of time before the alarm generating level is reached (this is encountered in, for example, a warehouse), the voltage to be impressed across the inner electrode 1 and the outer electrode 5 lowers considerably to spoil the detecting function of the sensors because it is divided by the impedance of the transistor Q, a resistance $R_1$ and the detecting resistance of a receiving unit (not shown), in addition to the cause of the leakage current increased in the transistor Q. Even when the quantity of the combustion product to detect the impedance change of the alarm generating level is thereafter reached in actuality, no detection output is provided from the circuit in some cases.

SUMMARY OF THE INVENTION:

An object of this invention is to provide an alarm output circuit having an ionization smoke sensor of a high impedance wherein a leakage current in a trigger circuit which receives an impedance change of the ionization smoke sensor and amplifies the impedance change output and which serves to render conductive a thyristor constituting on the power input terminal side of the alarm output circuit a shorting circuit including a relay for actuating associated peripheral means such as alarm sounding equipment is lessened, so that the normalized voltage of the alarm output circuit is maintained.

Another object of this invention is to provide an alarm output circuit wherein a trigger circuit is comprised which employs a comparator of a complementary type MOSIC having a high impedance and whose operating voltage for delivering an output is made greater than inputs based on impedance changes smaller than an impedance change at an alarm issuing level of an ionization smoke sensor, so that no output is delivered in response to the impedance changes below the alarm issuing level of the sensor.

Still another object of this invention is to provide an alarm output circuit wherein a trigger circuit is comprised which is constructed of a comparator of a complementary type MOSIC and which is connected to an output end of a zener diode, said zener diode being connected to the drain of a field effect transistor subject to an impedance change of an ionization smoke sensor so as to cause a sufficient current in case of the impedance change at an alarm issuing level, so that the leakage current of the trigger circuit is lessened by the high impedances of both the zener diode and the comparator.

This invention can enhance the operation reliability of a high impedance circuit having a d.c. power source wherein a power source short-circuiting loop is formed and wherein associated means are actuated through a relay incorporated in the loop. The general buildings, warehouses etc. are large in the volume or the number of storeys, so that the number of fire sensors employed is conspicuously large accordingly.

In order that the fire sensor may normally fulfill the function even at the service interruption of a commercial power source, a battery is used as the power source of the first sensor separately from the commercial power source. To the end of more effectively sensing a fire within the building large in the volume or the number of storeys without increasing the number of batteries from the viewpoint of the management thereof, the high impedance circuits which are provided with ionization smoke sensors capable of keenly detecting combustion products such as smoke and vapor are connected in large numbers to the same battery under the state under which they are independent of one another. To connect the large number of high impedance circuits to the common power source is easy because no power is dissipated for most ordinary substances other than the products of the fire. On the other hand, in order to generate a fire alarm when the rate of existance of the combustion product inside the building has exceeded a certain value, the impedance change of the ionization smoke sensor as arises at the rate of existance is made the alarm issuing level of the circuit. In this case, since an ionic current which is maintained by radioactive rays in the sensor is disturbed even by smoke and oscillations of the air which are not related to the fire, the sensor is always attended with an impedance change close to the alarm generating level. The high impedance circuit dissipates power also for such impedance changes smaller than the impedance change at the alarm issuing level. Therefore, when some of the large number of high impedance circuits allotted to the common power source fall into a condition of high power dissipation incidentally and simultaneously, power supplied to all the circuits lowers, and the impedance changes occurring in the sensors cannot be taken out at high accuracy. In case of a smoldering fire in which smoke increases very slowly, under the state under which the smoke gradually spreading at each floor or over a large area of space is neraly of the quantity of smoke at the alarm generating level, many of the high impedance circuits are in the condition of high power dissipation and give rise to a marked drop of the applied voltage. In such case, therefore, the situation can take place in which the fire detecting operation is not effected in spite of the occurrence of the fire.

In order to more enhance the availability of the alarm circuit arrangement made up of the large number of high impedance circuits connected to the common d.c. power source, this invention lessens leakage currents ascribable to the impedance changes smaller than the impedance change of the alarm issuing level, whereby the reliability of the operations of the large number of circuits can be raised.

DETAILED DESCRIPTION OF THE INVENTION

Figure 3:
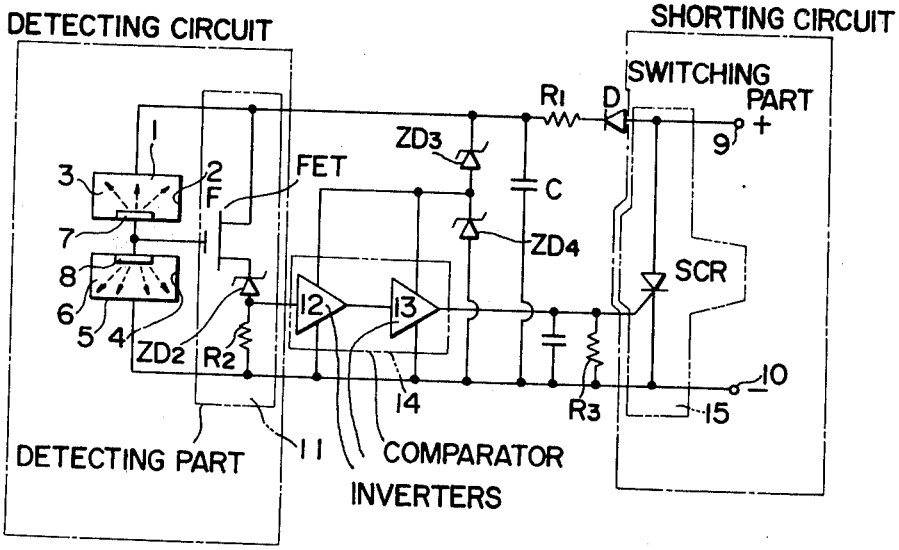
FIG. 3 is a circuit diagram which shows an embodiment of this invention with parts omitted.

Referring to FIG. 3, an ionization smoke sensor has a reference ionization chamber 3 which consists of an inner electrode 1 and an intermediate electrode 2, a measuring ionization chamber 6 which consists of an intermediate electrode 4 and an outer electrode 5, and radiation sources 7 and 8. For the performance of this invention, an ionization smoke sensor which has only the measuring ionization chamber combined with a reference resistance or which has only one radiation source is similarly used. Across the inner electrode 1 and the outer electrode 5, a fixed voltage is applied from d.c. power supply terminals 9 and 10 through a diode D as well as a resistance $R_1$ and via a constant voltage circuit consisting of a capacitor C and a zener diode $ZD_1$ (or $ZD_3$). Radioactive rays from the radiation sources 7 and 8 ionize air in the reference ionization chamber 3 and in the measuring ionization chamber 6, respectively, to maintain ionic currents owing to the applied voltage.

When smoke given forth by a fire enters into the measuring ionization chamber 6, the ionic current decreases to increase a voltage between the intermediate electrode 4 and the outer electrode 5. In response to the voltage increase, an FET (field effect transistor) which constitutes a detecting circuit 11 is rendered conductive, a zener current flows through a zener diode $ZD_2$, and a voltage appears across a resistance $R_2$ and is loaded on a comparator 14.

The comparator 14 is a complementary type MOSIC which has a high input impedance, and in which inverters 12 and 13 made of complementary type MOSIC's are combined. A supply voltage $V_{DD}$ which is lower than the voltage impressed between the inner electrode 1 and the outer electrode 5 and which is obtained by dividing it by zener diodes $ZD_3$ and $ZD_4$. The voltage $V_{DD}$ is determined in correspondence with a voltage necessary for triggering an SCR of a switching circuit 15 which serves to shortcircuit the power source. The required voltage $V_{DD}$ is determined from another requisite that the complementary type inverters 12 and 13 can be operated by an operating voltage of the detector circuit 11 provided in correspondence with an impedance charge in the sensor at an alarm generating level. In other words, the operating voltage of the detector circuit 11 and a voltage $V_{DD}/2$ for causing the complementary type inverters 12 and 13 to operate are made identical. The operating voltage $V_{DD}$ of the comparator 14 is determined from the trigger voltage of the thyristor SCR and the operating voltage of the detector circuit 11, and is set at a required value by altering the dividing condition of the zener diodes $ZD_3$ and $ZD_4$ (the zener diode $ZD_4$ may be replaced with an equivalent circuit for the voltage division).

Figure 1:
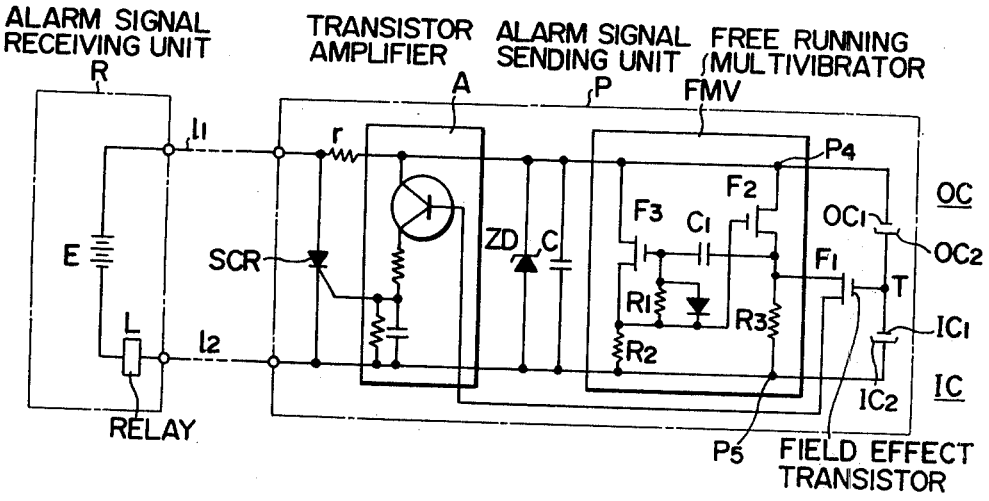
FIG. 1 PRIOR ART
FIG. 1 shows a prior-art circuit disclosed in U.S. Pat. No. 3,733,596.
Figure 2:
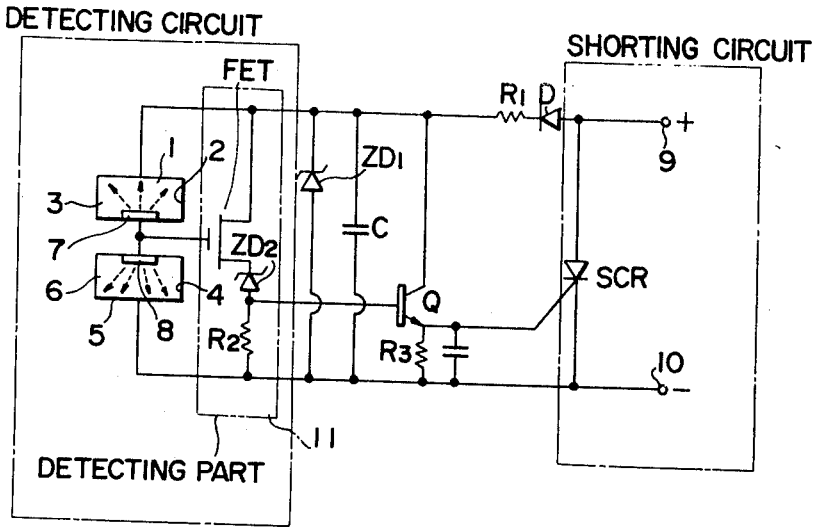
FIG. 2 shows a circuit of reference in which an FMV in the circuit of FIG. 1 is removed and some alternations are made.

In the embodiment, even when the output voltage of the detector circuit 11 changes in a voltage range lower than the determined operating voltage, the voltage $V_{DD}/2$ is not exceeded, and hence, the set of the inverters 12 and 13 does not operate. The current dissipation can therefore be made lower than that of the trigger circuit of the comparator circuit in FIG. 2 as employs the transistor Q. There may well be provided a positive feedback circuit in which a resistance is incorporated between the output end of the inverter 13 and the input end of the inverter 12. Further, the expedient of this invention to render the operating voltage of the comparator 14 lower than in the circuit of FIG. 2 can make the voltage condition of the switching operation clear, can reduce the current dissipation still more, and can more enhance the reliability of the operation of a large number of high impedance circuits connected to the common d.c. power source.

What is claimed is:

1. A high impedance circuit arrangement having ionization smoke sensors, comprising the ionization smoke sensor which has a high impedance and which is included in each of a plurality of alarm circuits connected to a common d.c. power source and being independent of one another, a power source shorting circuit which is so formed that a thyristor adapted to short-circuit said power source when triggered is connected in parallel with the corresponding ionization smoke sensor, said each shorting circuit including a relay which is energized by a current increased when said power source is shortcircuited and which serves to actuate peripheral means, a detecting circuit which is so formed that a semiconductor element adapted to current-amplify an impedance change of the corresponding ionization smoke sensor is connected in parallel with said ionization smoke sensor under the state of parallel connection to the corresponding shorting circuit, and a trigger circuit which is connected between an output end of the corresponding detecting circuit and a gate of the corresponding thyristor and which has a pair of inverters connected in a complementary relationship, whereby said pair of inverters hold the corresponding trigger circuit "off" in response to an output from the corresponding detecting circuit as is smaller than an operating voltage of said inverters, while they transmit a normalized voltage from said trigger circuit to the gate of the corresponding thyristor to turn said thyristor "on" and to close the corresponding shorting circuit in response to an output not smaller than said operating voltage.

2. The high impedance circuit arrangement according to claim 1, wherein said each detecting circuit consists of a field effect transistor whose gate is subject to the impedance change of the corresponding ionization smoke sensor and a zener diode and a resistance which are connected in series with a drain of said field effect transistor, and said each trigger circuit has its input end connected to an output end of said detecting circuit between said zener diode and said resistance, whereby leakage currents in said detecting circuit and said trigger circuit are reduced.

3. The high impedance circuit arrangement according to claim 1, wherein a power supply terminal voltage of said trigger circuit is made lower than a supply voltage of said detecting circuit.

4. The high impedance circuit arrangement according to claim 3, wherein two zener diodes connected in series are connected in parallel with a feeder line of said detecting circuit, and power source terminals of said trigger circuit are connected to a juncture between said two zener diodes and to said feeder line.

* * * * *